US007381138B2

(12) United States Patent
Dillner et al.

(10) Patent No.: US 7,381,138 B2
(45) Date of Patent: Jun. 3, 2008

(54) INFANT SWING

(75) Inventors: James Dillner, Leola, PA (US); Kenneth C. Waldman, Reading, PA (US); Jerome Drobinski, Reading, PA (US)

(73) Assignee: Simplicity Inc., Reading, PA (US)

( * ) Notice: Subject to any disclaimer, the term of this patent is extended or adjusted under 35 U.S.C. 154(b) by 291 days.

(21) Appl. No.: 11/208,244

(22) Filed: Aug. 19, 2005

(65) Prior Publication Data

US 2006/0111194 A1 May 25, 2006

Related U.S. Application Data

(63) Continuation-in-part of application No. 10/910,160, filed on Aug. 3, 2004, now Pat. No. 7,275,996.

(51) Int. Cl.
*A63G 9/16* (2006.01)

(52) U.S. Cl. ..... 472/119; 5/108

(58) Field of Classification Search ..... 472/118–125; 5/108, 109; 297/273
See application file for complete search history.

(56) References Cited

U.S. PATENT DOCUMENTS

| | | | | |
|---|---|---|---|---|
| 2,520,377 | A | 8/1950 | Schrougham | |
| 3,649,074 | A | 3/1972 | McDonald et al. | |
| 3,731,342 | A | 5/1973 | Cousin | |
| 3,883,136 | A | 5/1975 | Kim | |
| 4,240,625 | A | 12/1980 | Meeker | |
| 4,324,432 | A | 4/1982 | Eldon, III et al. | |
| 4,325,578 | A | 4/1982 | Borucki | |
| 4,382,595 | A | 5/1983 | Tolar | |
| 4,697,845 | A | 10/1987 | Kamman | |
| 5,393,268 | A | 2/1995 | Cunard et al. | |
| D368,816 | S | 4/1996 | Mitchell et al. | |
| 5,562,548 | A | 10/1996 | Pinch et al. | |
| 5,653,417 | A | 8/1997 | DeBarber et al. | |
| 5,803,817 | A | 9/1998 | Stern | |
| 5,803,818 | A | 9/1998 | Tseng | |
| 5,846,136 | A * | 12/1998 | Wu | 472/119 |
| 5,951,108 | A | 9/1999 | Bauer et al. | |
| 5,975,631 | A | 11/1999 | Fair et al. | |
| 5,984,791 | A | 11/1999 | Fair et al. | |
| 6,022,277 | A | 2/2000 | Jankowski | |
| 6,024,410 | A | 2/2000 | Yoshida | |

(Continued)

FOREIGN PATENT DOCUMENTS

| | | | |
|---|---|---|---|
| GB | 2 358 793 | A | 8/2001 |

*Primary Examiner*—Kien Nguyen
(74) *Attorney, Agent, or Firm*—Volpe and Koenig, P.C.

(57) ABSTRACT

An infant swing comprising a seat, at least one upwardly extending arm secured to the seat, and a pivot housing having an axle for rotating the at least one upwardly extending arm. A support frame supports the pivot housing and enables the seat to rotate freely about the pivot housing. A drive assembly housed within the pivot housing includes the axle which is rotatably mounted in the pivot housing and coupled to the upwardly extending arm, an abutting member fixedly secured to the axle, at least one drive member pivotally mounted on the axle, and a motor driving a circular gear. A rod eccentrically mounted on the gear drives a first portion of the drive member, which in turn causes a second portion of the drive member to drive the abutting member to rotate the axle and upwardly extending arm.

30 Claims, 16 Drawing Sheets

U.S. PATENT DOCUMENTS

| | | | | |
|---|---|---|---|---|
| 6,027,409 | A | 2/2000 | Favorito et al. | |
| 6,193,224 | B1 | 2/2001 | Dillner et al. | |
| 6,251,023 | B1 | 6/2001 | Lauro et al. | |
| 6,386,986 | B1 | 5/2002 | Sonner et al. | |
| 6,471,597 | B1 | 10/2002 | Flannery et al. | |
| 6,520,862 | B1 | 2/2003 | Armbruster et al. | |
| 6,626,766 | B1 | 9/2003 | Hsia | |
| 6,645,080 | B1 | 11/2003 | Greger et al. | |
| 6,666,505 | B2 | 12/2003 | Greger et al. | |
| 6,702,685 | B2 | 3/2004 | Mahlstedt et al. | |
| 6,705,950 | B2 | 3/2004 | Wood et al. | |
| 6,875,117 | B2 * | 4/2005 | Ransil et al. | 472/119 |
| 6,896,624 | B2 | 5/2005 | Longenecker et al. | |
| 2003/0160487 | A1 | 8/2003 | Flannery et al. | |
| 2004/0102253 | A1 | 5/2004 | Ransil et al. | |

* cited by examiner

FIG. 4
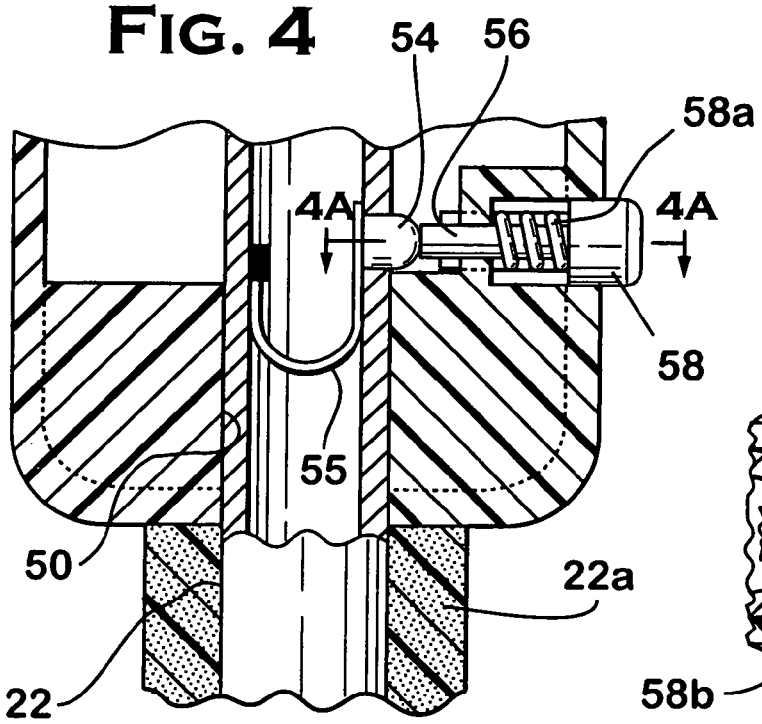
FIG. 4A
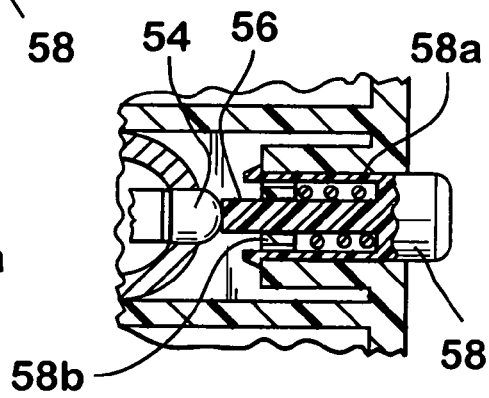
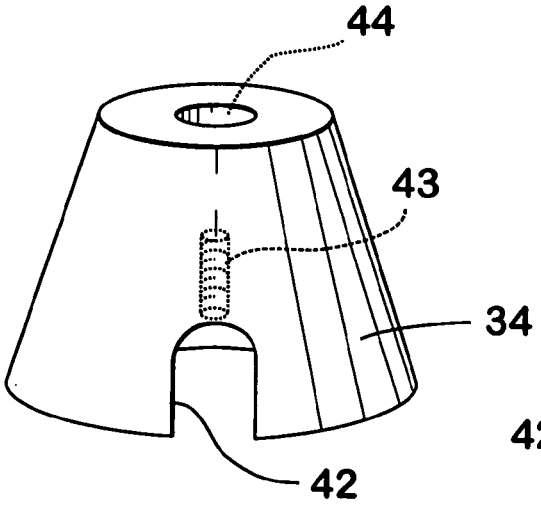
FIG. 6
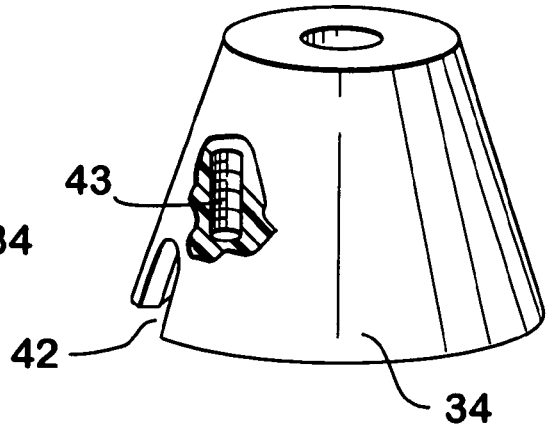
FIG. 6A

FIG. 12
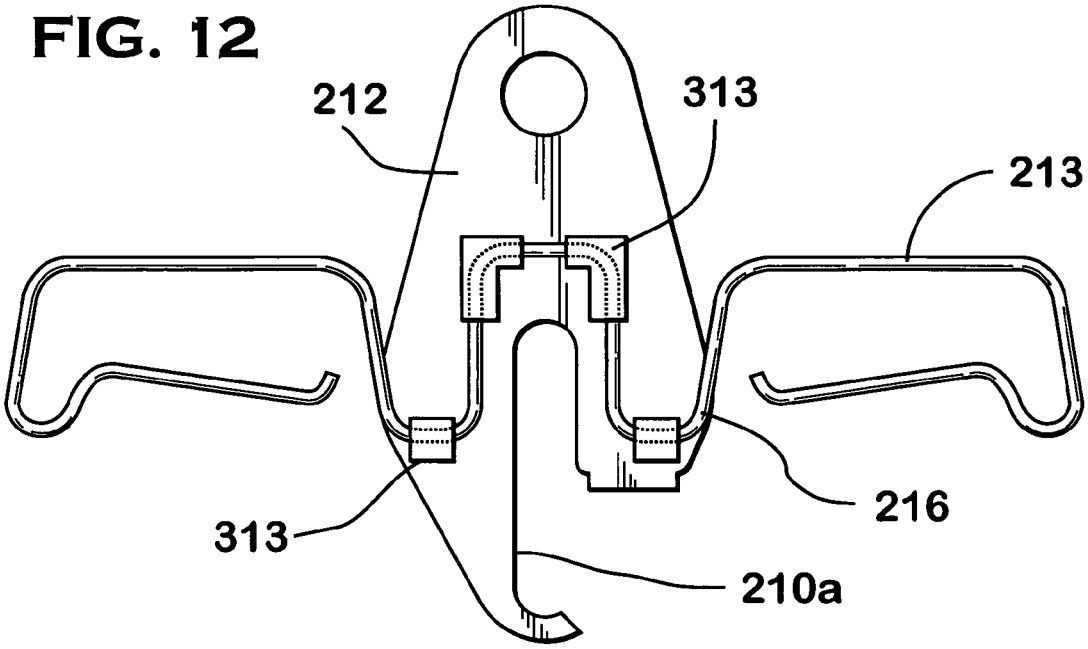
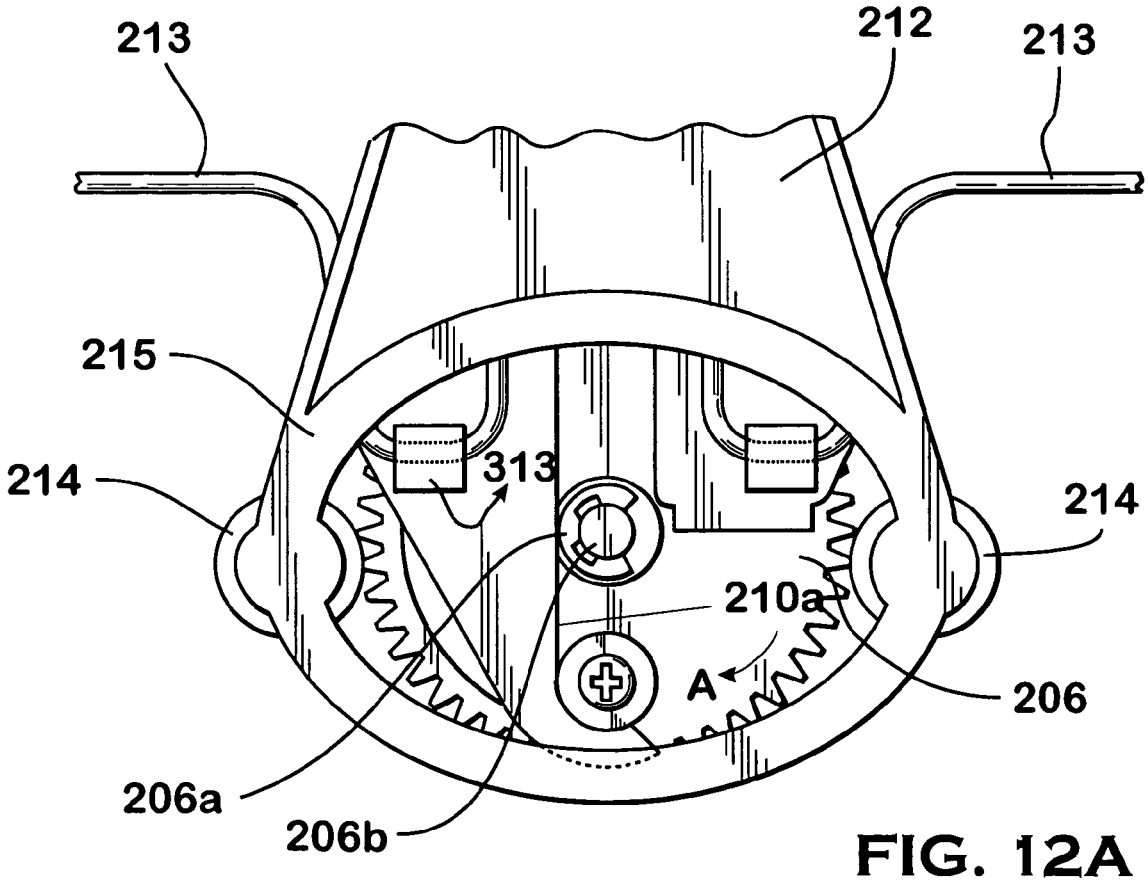
FIG. 12A

INFANT SWING

CROSS REFERENCE TO RELATED APPLICATION

This application is a continuation-in-part of U.S. patent application Ser. No. 10/910,160, filed Aug. 3, 2004, now U.S. Pat. No. 7,275,996 which is incorporated by reference as if fully set forth.

FIELD OF INVENTION

This invention relates to a motorized infant swing.

BACKGROUND

Infant child swings provide entertainment for children too small to operate a normal swing. Although early swings used mechanical motors to drive the child, modern infant swings use an electromechanical motor assembly. There are several design concerns for swing design. First, a swing must be stable and safe. Second, the swing should be designed to provide maximum battery life. Third, a child should be comfortable and entertained in the swing. Fourth, the swing should be able to be easily packed and stored.

SUMMARY

One aspect of the present invention is directed to an infant swing comprising a seat for holding an infant, at least one upwardly extending arm secured to the seat, at least one pivot housing rotatably connected to the at least one upwardly extending arm, a support frame that extends upwardly from a support surface, the support frame engaging the at least one pivot housing and configured to enable the seat to rotate freely about the pivot housing, and at least one drive assembly housed within the at least one pivot housing. The drive assembly includes an axle mounted in the at least one pivot housing and having one end joined to the at least one upwardly extending arm, an abutting member fixedly secured to the axle, at least one drive member pivotally mounted on the axle, the at least one drive member having a first portion adjacent to the abutting member and a second portion, and a motor seated within the at least one pivot housing, the motor being configured to drive a circular gear rotatably mounted in the pivot housing, the circular gear having a rod mounted eccentrically thereon and extending parallel to the axis of rotation of the circular gear, the rod adapted to engage the second portion of the at least one drive member. Rotation of the circular gear drives the rod generally in a first direction to drive the second portion of the drive member in the first direction, which in turn drives the first portion of the drive member against the abutting member to rotate the axle and the at least one upwardly extending arm in a given direction.

Another aspect of the present invention is directed to a drive assembly for an infant swing comprising an axle coupled to at least one upwardly extending arm of a swing seat, an abutting member fixedly secured to the axle, at least one drive member pivotally mounted on the axle, the at least one drive member having a first portion adjacent to the abutting member and a second portion, and a motor configured to drive a circular gear. The circular gear has a rod mounted eccentrically thereon and extends parallel to the axis of rotation of the circular gear. The rod selectively engages the second portion of the at least one drive member. Rotation of the circular gear and the rod through a first given angular portion drives the second portion of the at least one drive member in a first direction, which in turn causes the first portion of the at least one drive member to drive the abutting member in a given direction to rotate the axle and hence the swing seat.

BRIEF DESCRIPTION OF THE DRAWINGS

The foregoing summary, as well as the following detailed description of preferred embodiments of the invention, will be better understood when read in conjunction with the appended drawings. In the drawings:

FIG. 4 is a cross-sectional view of a locking assembly looking in the direction of arrows 4-4 in FIG. 1.

FIG. 4A is a cross-sectional view of the locking assembly looking in the direction of arrows 4A-4A in FIG. 4.

FIG. 6 is a perspective view of a swing foot.

FIG. 6A is a perspective side view of the swing foot of FIG. 6 showing the open cylinder in a partial cutaway.

FIG. 12 shows the arm plate of the second embodiment of the drive assembly.

FIG. 12A is an enlarged view of the engagement between the arm plate and rotational rod of the second embodiment of the drive assembly.

DETAILED DESCRIPTION OF THE PREFERRED EMBODIMENTS

Certain terminology is used in the following description for convenience only and is not limiting. The words "right," "left," "top," "bottom," "side," "front," "rear," "central," "upper," and "lower" designate positions in the attached drawings. The words "inwardly" and "outwardly" refer to directions toward and away from, respectively, the geometric center of the swing and designated parts thereof.

Figure 1:
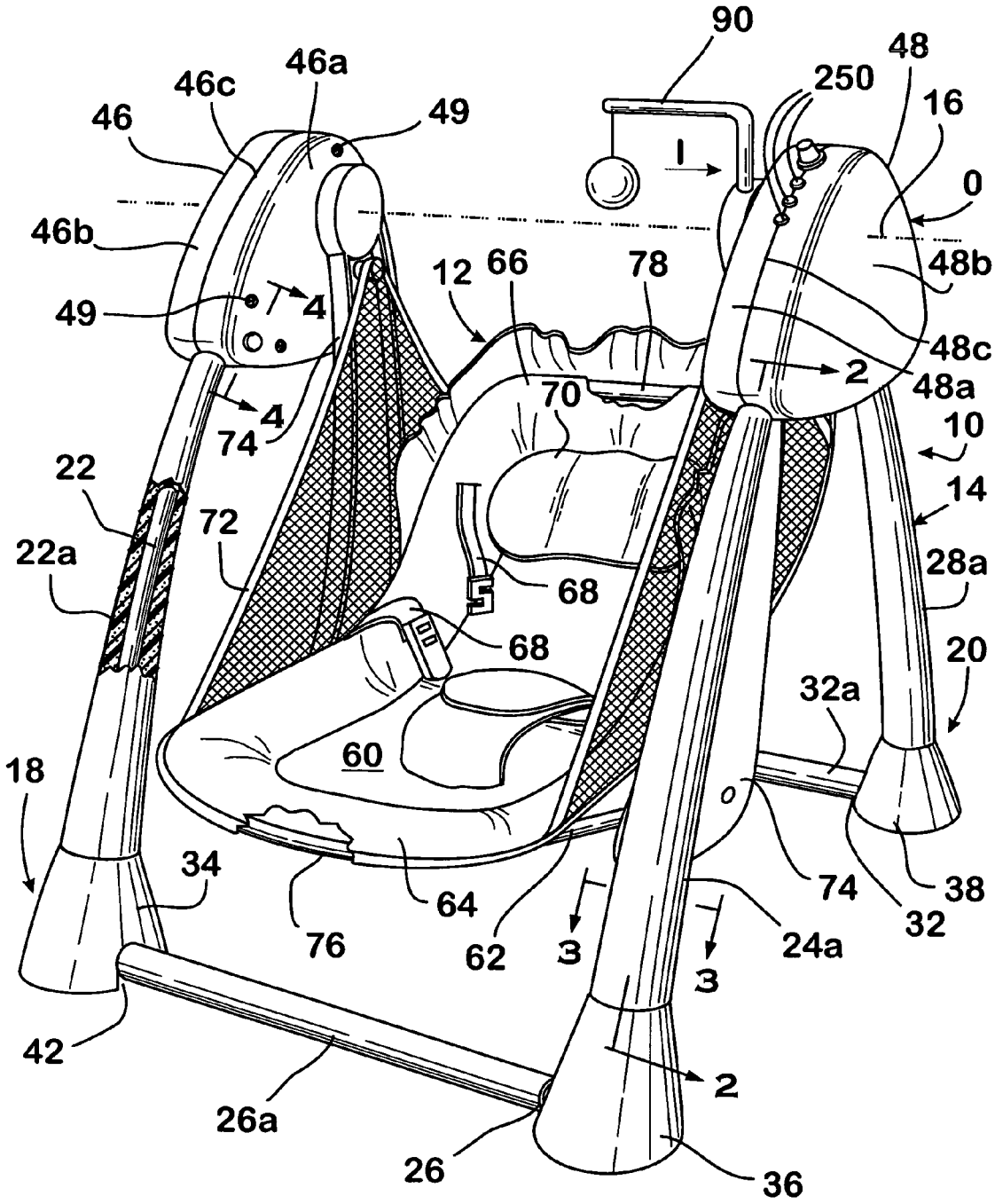
FIG. 1 is a perspective view of the swing with partial cutaways showing the seat frame and one leg of the front support.

FIG. 1 shows a swing 10 having a support frame 14 that supports a hanging seat 12 that swings about an axis of rotation 16.

Figure 2:
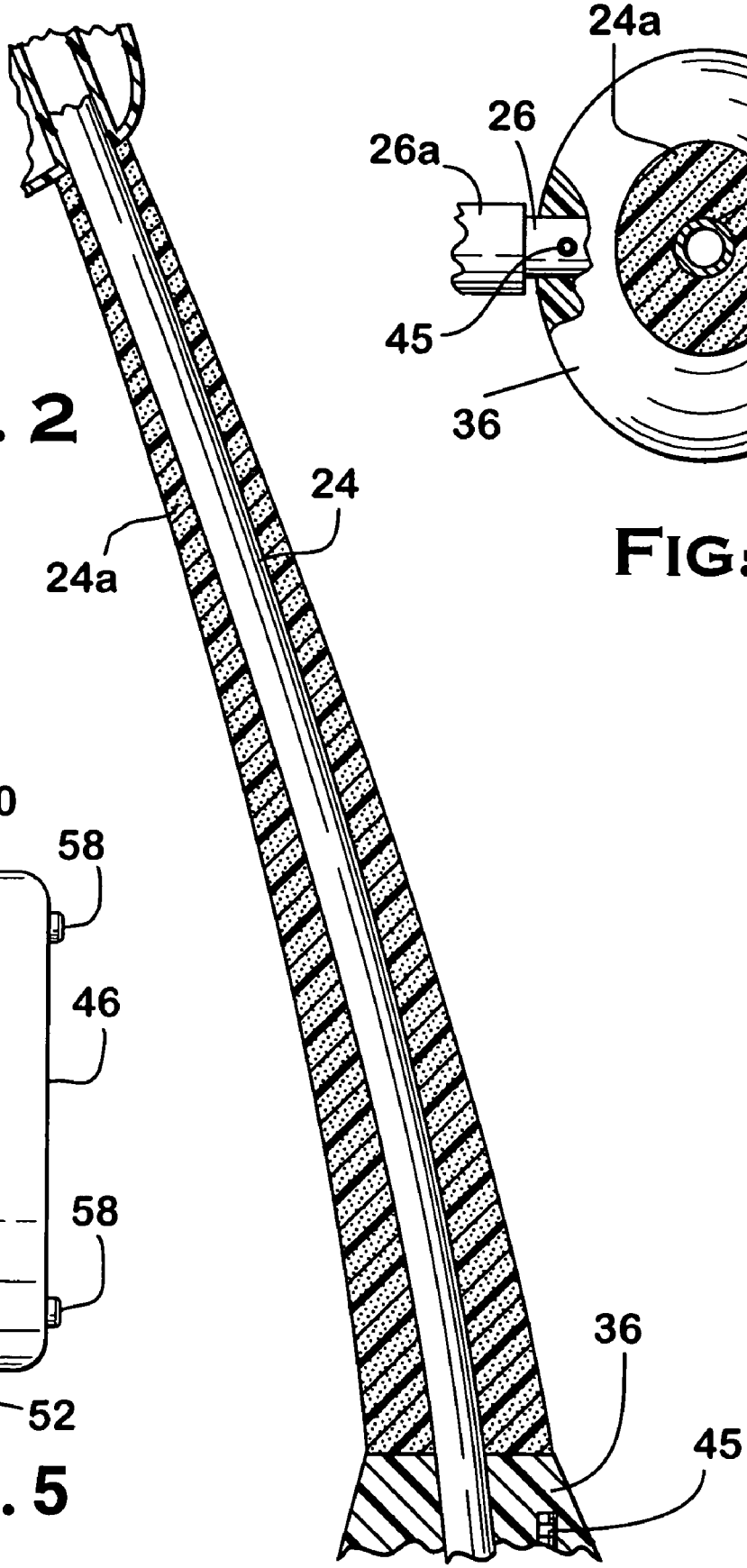
FIG. 2 is a cross-sectional view of a leg of the swing looking in the direction of arrows 2-2 in FIG. 1.
Figure 3:
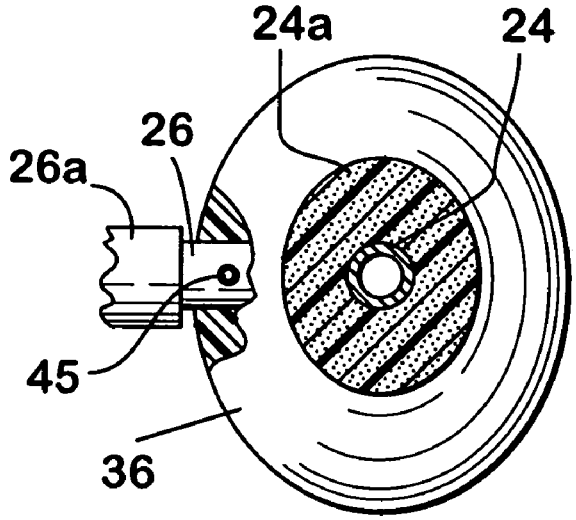
FIG. 3 is a cross-sectional view of a leg of the swing looking in the direction of arrows 3-3 in FIG. 1.

The frame 14 has a front and a rear support 18, 20. Front support 18 is comprised of a two generally diagonally aligned, curved legs 22, 24 joined to a horizontal support member 26. Similarly, rear support 20 is comprised of two generally diagonally aligned, curved legs 28, 30 joined to a horizontal support member 32. Each of the legs 22, 24, 28, 30 are surrounded by a foam padding 22*a*, 24*a*, 28*a*, 30*a*. The cutaway in FIG. 1 showing leg 22 beneath foam padding 22*a* and the cutaway in FIG. 2 showing leg 24 beneath foam padding 24*a*, are representative of legs 28 and 30 and their respective foam paddings 28*a* and 30*a*. The padding 22*a*, 24*a*, 28*a*, 30*a* on legs 22, 24, 28, 30 is thicker at the base of each leg than at the top of the leg. This padding provides more cushioning in areas where the swing 10 will be bumped more, i.e. the bottom of the swing 10. Each horizontal support member 26, 32 is similarly surrounded by padding 26*a*, 32*a* of a generally uniform thickness (FIG. 3, which shows horizontal support member 26 surrounded by padding 26*a*, is representative of horizontal member 32 and padding 32*a*).

As shown in FIGS. 1-3, 6, and 6A, each of legs 22, 24, 28, 30 are supported by a respective foot 34, 36, 38, 40. Referring to FIGS. 6 and 6A, each foot 34, 36, 38, 40 has a through-hole 44 that is adapted to receive a respective leg 22, 24, 28, 30 and an opening 42 adapted to receive a respective end of one of horizontal members 26, 32. The frame's 14 oversized semi-conical feet 34, 36, 38, 40 extend outside the perimeter of the frame 14 to provide extra stability to the swing 10 during operation. Each foot 34, 36, 38,40 preferably includes an open cylinder 43 that accepts a fastener 45, such as a screw or compression-fitted snap member, that extends through and secures it to a respective horizontal member 26, 32. Each foot 34, 36, 38, 40 can also be attached to supports 18 and 20 in any similar manner (not shown).

Figure 5:
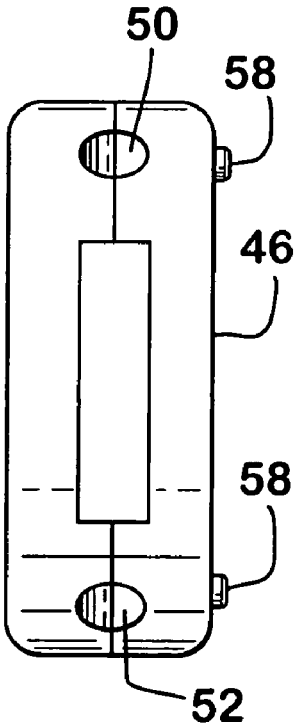
FIG. 5 is a bottom view of the pivot housing.

With reference to FIGS. 4, 4A, and 5, legs 22, 24, 28, 30 are removably attached to right and left pivot housings 46, 48. Pivot housings 46, 48 each contain front and rear recesses 50, 52 to receive legs 22, 24, 28, 30, as shown in FIGS. 1, 4, and 5 (the removable attachment between pivot housing 36 and legs 22 and 24 will be discussed herein and is representative of the removable attachment between pivot housing 48 and legs 28 and 30). Legs 22, 24, 28, 30 each contain a spring-biased push button 54 that engages a corresponding interior end 56 of a spring biased release button 58 within pivot housings 46, 48. Each pivot housing 46, 48 comprises interior walls 46*a*, 48*a* and exterior walls 46*b*, 48*b* joined along seam 46*c*, 48*c* using screws 49 that extend from each housing half to the other. Each housing 46, 48 contains a pair of spring-biased release buttons 58 that correspond to each of legs 22, 24, 28, 30. Spring biased release buttons 58 are each biased by a spring 58*a* that presses against button 58 and a stop 58*b*. Pressing on the spring biased release buttons 58 drives the interior end 56 against push button 54, which allows legs 22, 24, 28, 30 to be disengaged and removed from the recesses 50, 52. FIG. 4 shows a leaf spring 55 as the bias element for the leg button 54, however, other bias means such as compression springs or elastomeric fillers could be used.

Figure 7:
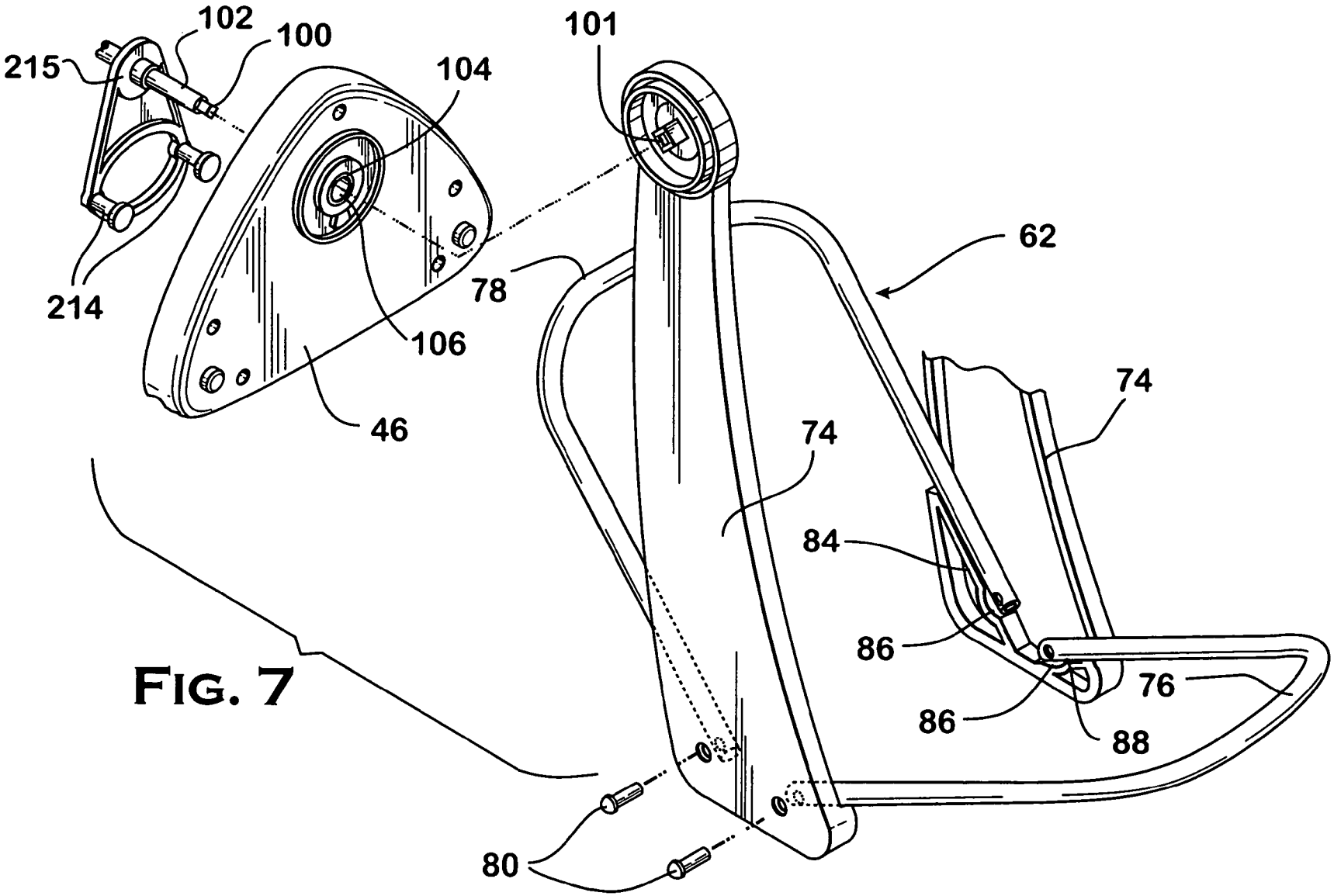
FIG. 7 is an exploded view of the seat and pivot housing engagement of a first embodiment of the drive assembly of the present invention.

With reference to FIGS. 1 and 7, the hanging seat 12 comprises a padded seat cover 60 and a seat frame 62. The padded seat cover 60 has a leg portion 64 and a back portion 66, upon which a child's legs and back respectively rest. The padded seating area 60 also has a harness assembly 68 that secures the child in the swing 10, and a padded headrest 70 for the child's head. The harness assembly 68 engages the child's groin and shoulders. Web 72 (or other preferably flexible material could be used) attached to the seat 12 discourages a child from reaching into the regions of the legs 22, 24, 28, 30 where a hand or leg could be injured. Also, the flexible web 72 facilitates disassembly and storage in a more compact manner.

The seat frame comprises at least one (although two are shown) upwardly extending arms 74. The seat frame 62 includes a substantially U-shaped leg member 76 and back member 78 shown with the padding removed in FIG. 7. The members 76, 78 are contained within pockets in the padded seat cover 60 and provide a stable surface for a child to sit upon.

Figure 13:
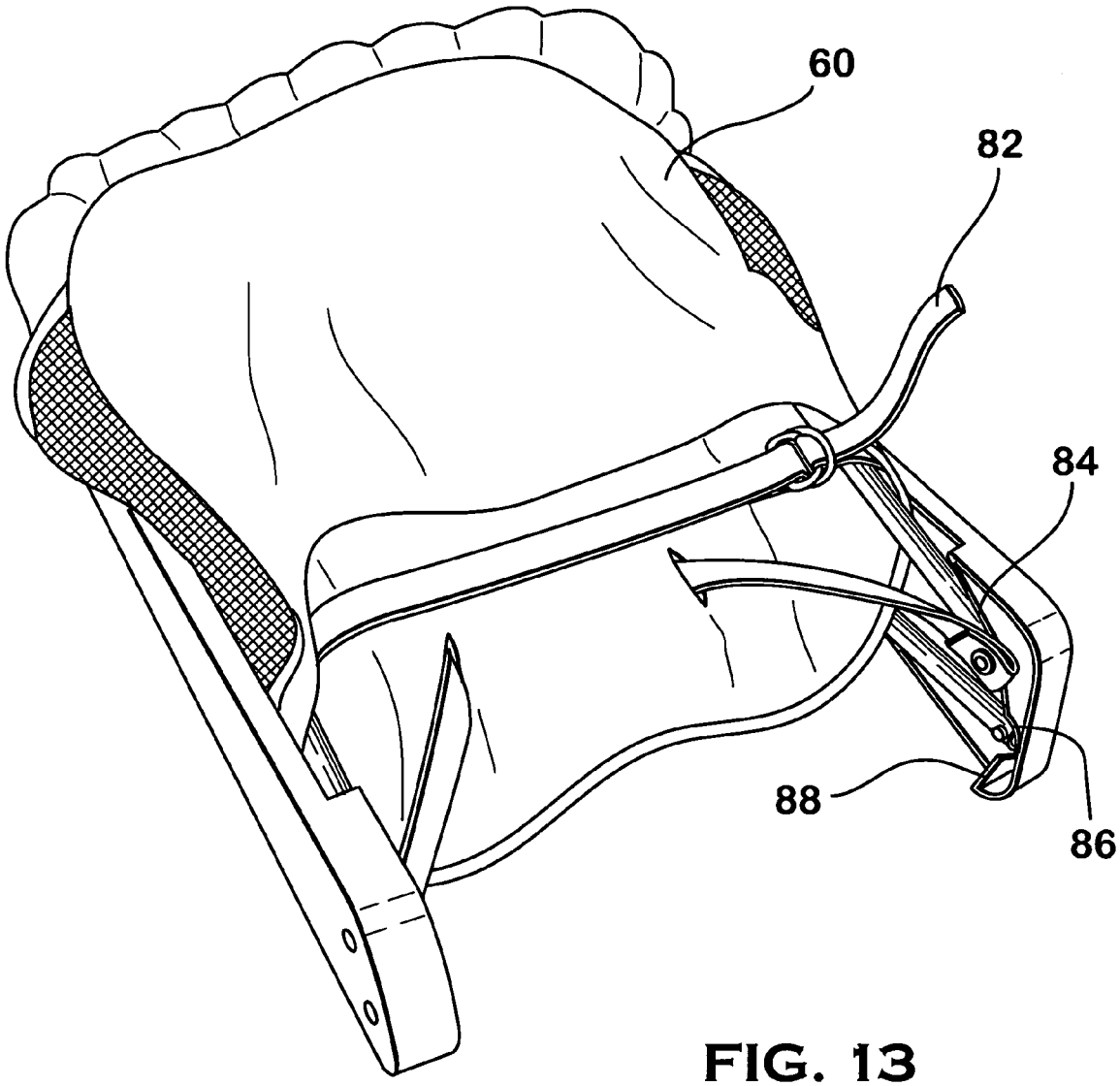
FIG. 13 shows a back view of the seat.
Figure 14:
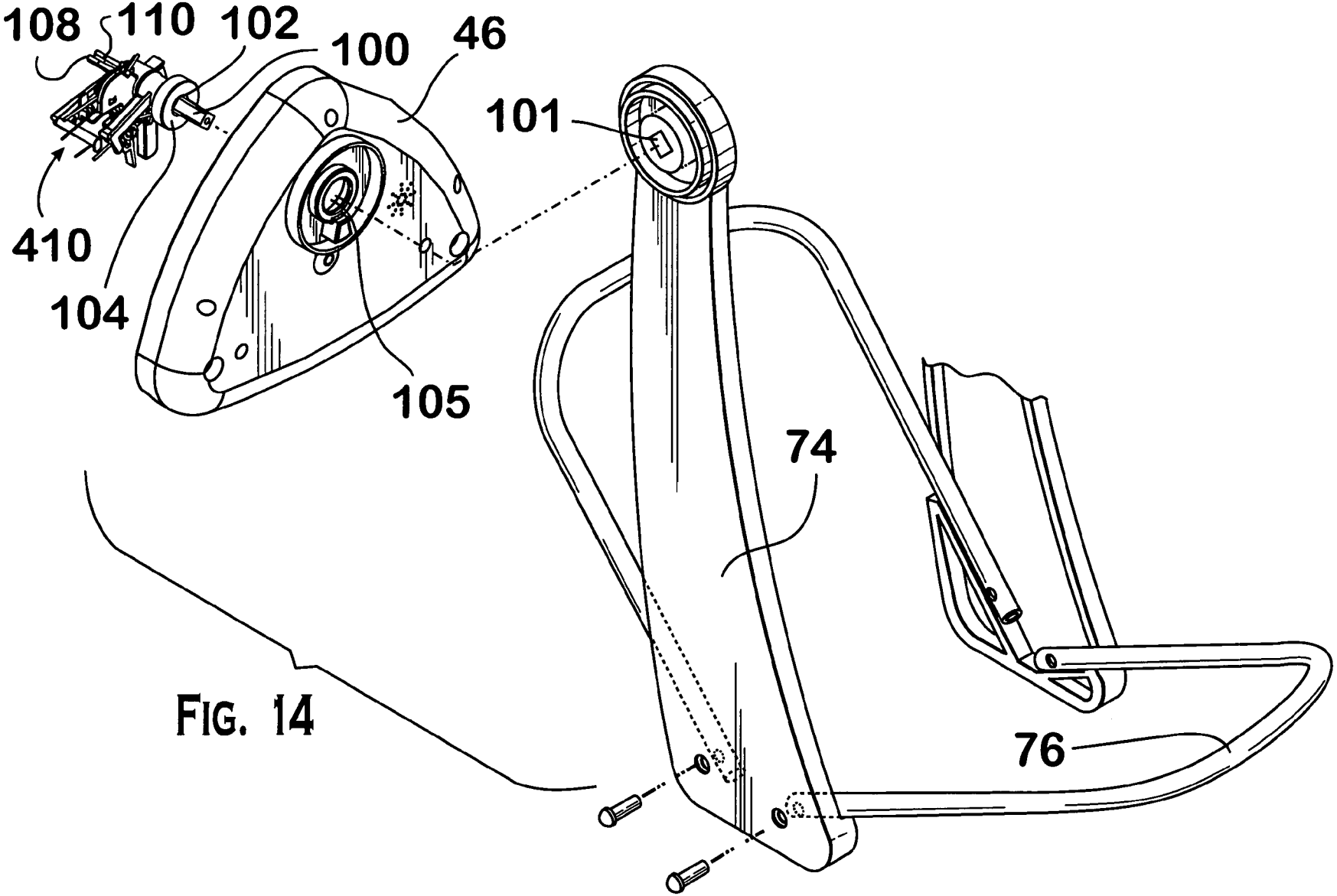
FIG. 14 is an exploded view of the seat and pivot housing engagement of a third embodiment of the drive assembly of the present invention.
Figure 15:
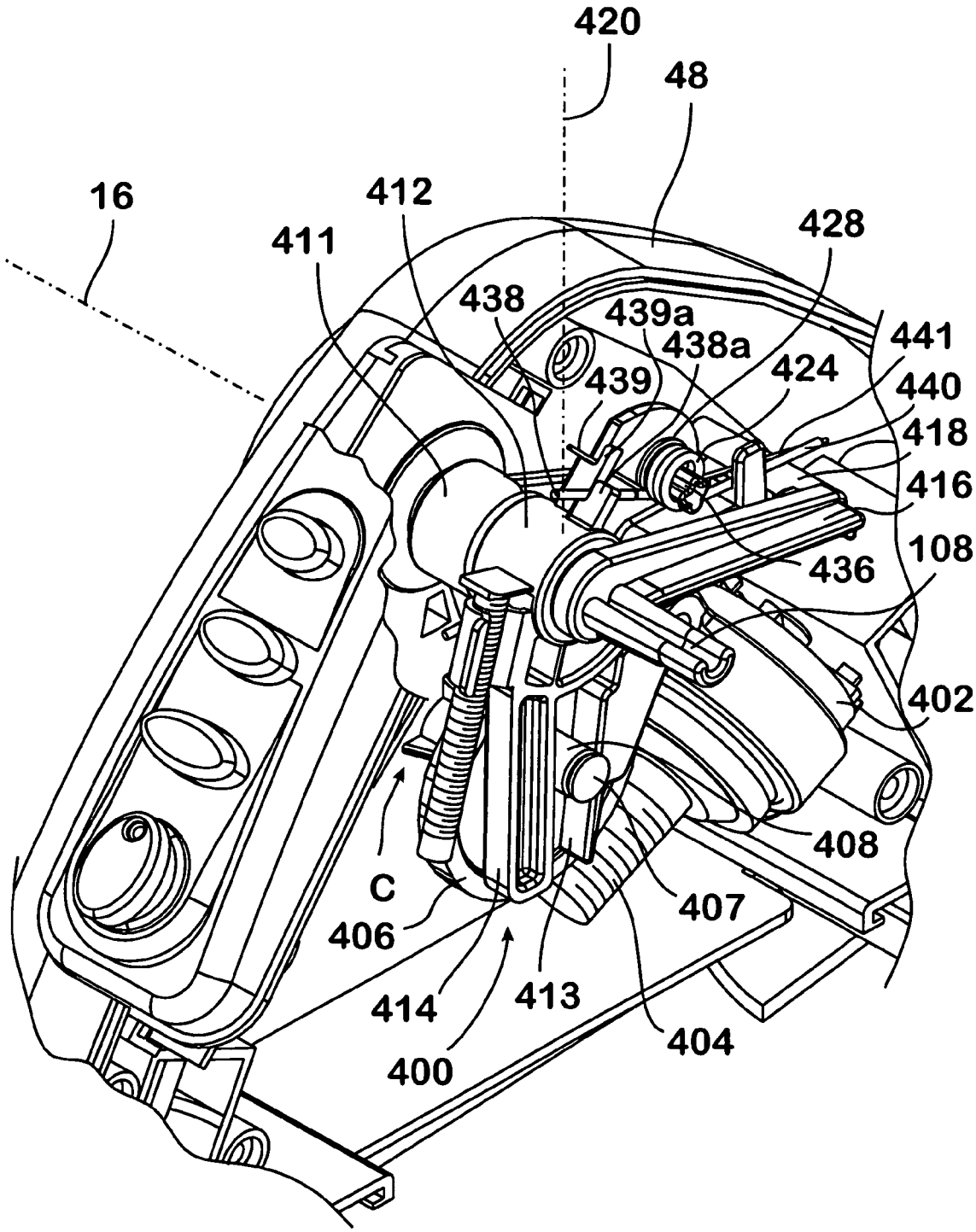
FIGS. 15-16 are partial perspective views of the interior of the pivot housing showing the third embodiment of the drive assembly taken from the perspective of arrow I in FIG. 1.
Figure 16:
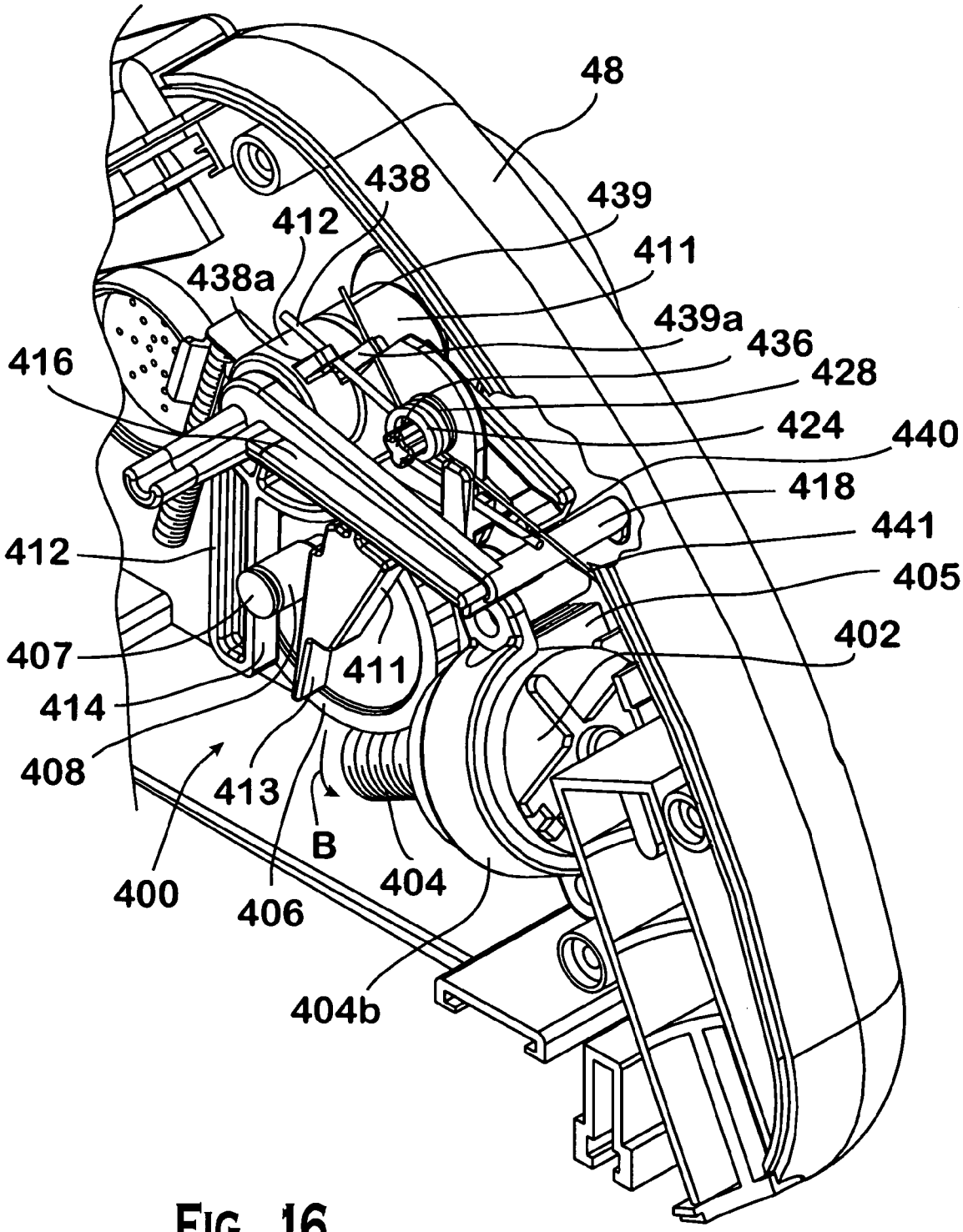
Figure 17:
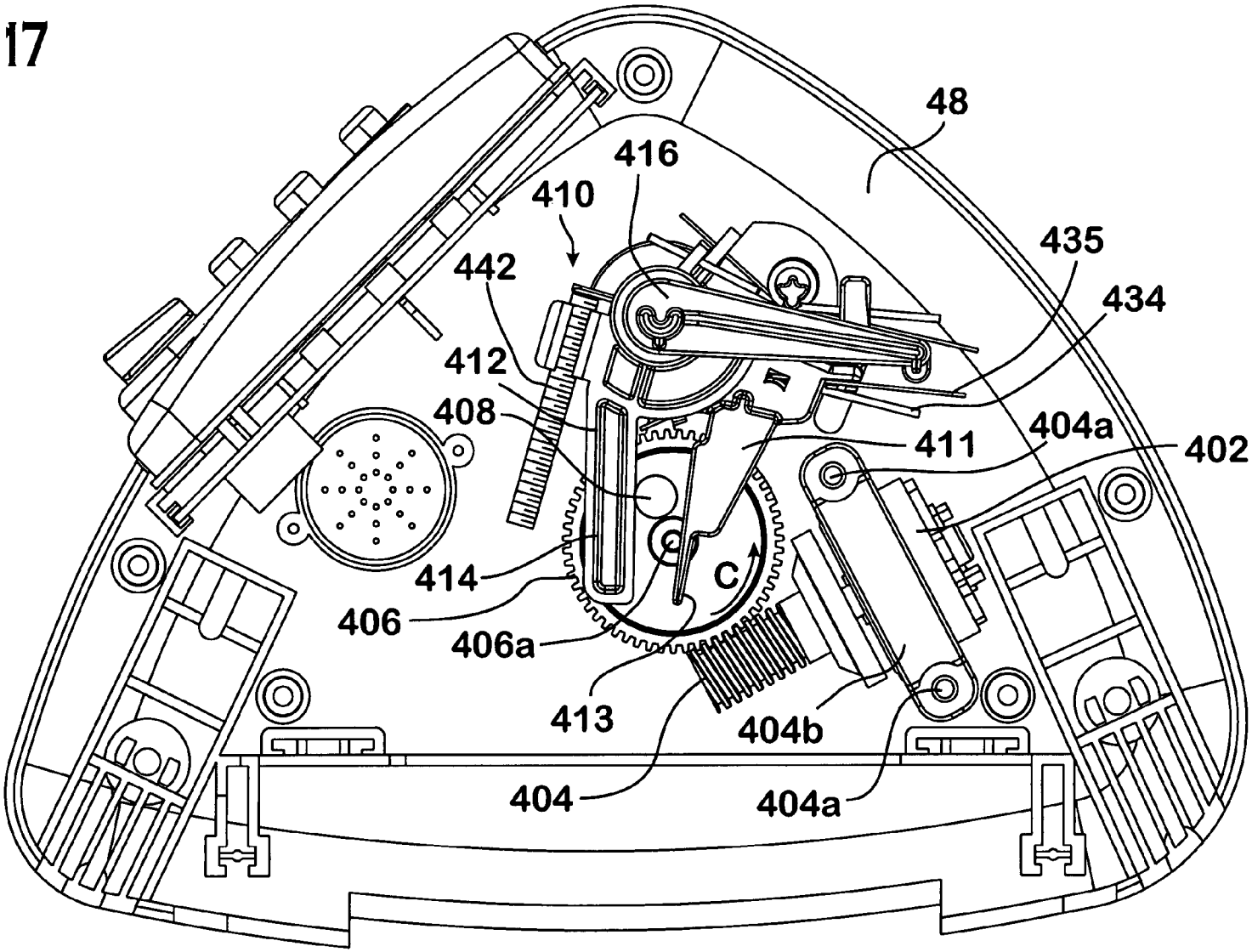
FIG. 17 is a plan view of the interior of the pivot housing showing the third embodiment of the drive assembly of the present invention taken from the perspective of arrow O in FIG. 1.
Figure 18:
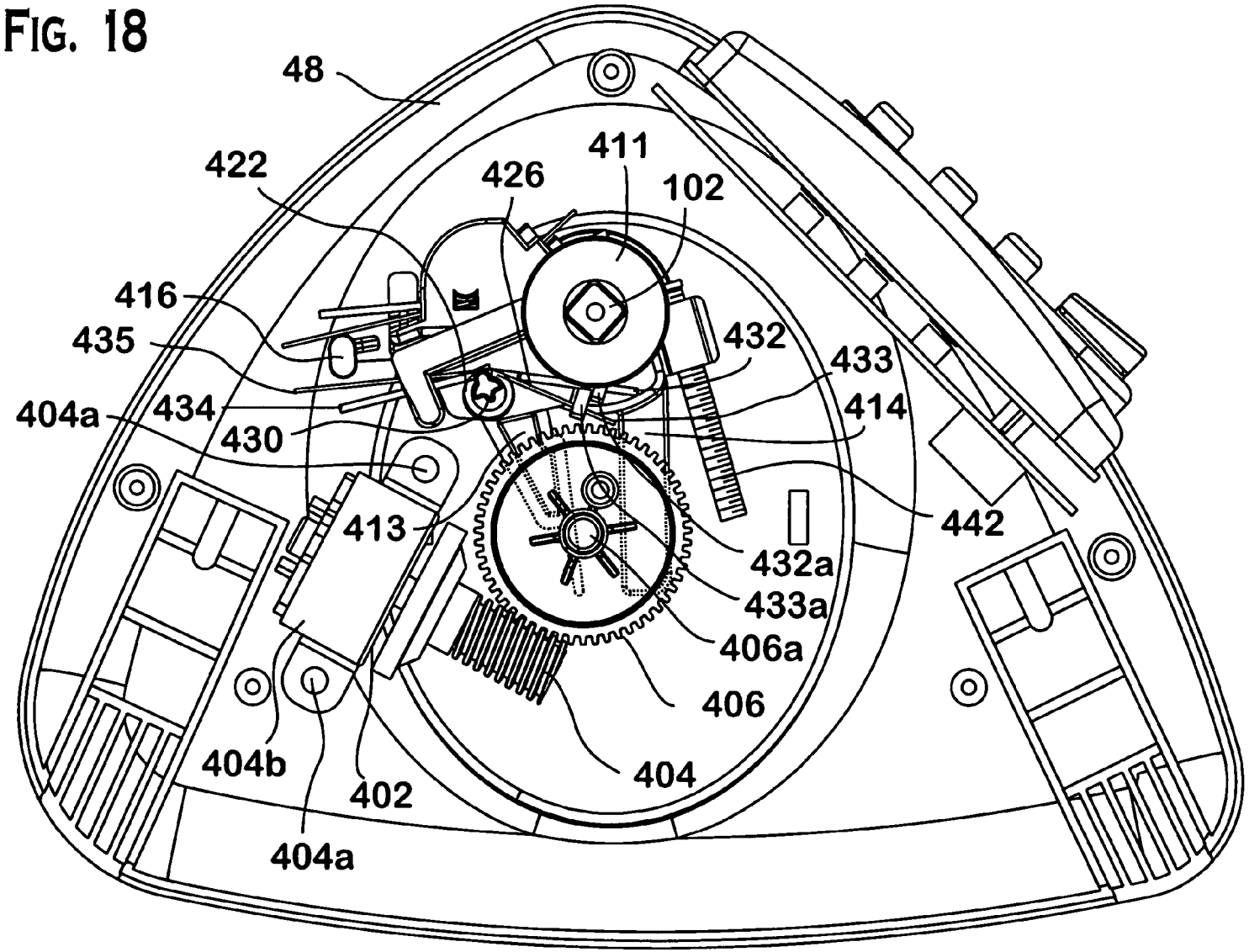
FIG. 18 is a partial elevational view of the interior of the pivot housing showing the third embodiment of the drive assembly taken from the perspective of arrow I in FIG. 1.

The members 76, 78 are each rotatably connected to the upwardly extending arms 74, preferably at rounded out grooves 86 of the extending arms 74, such that the seat 12 can be folded onto itself for storage, or reclined for comfort. Referring to FIGS. 1, 7 and 13, reclining the seat back portion 66 about pins 80 is possible by adjusting strap 82 that is connected to the padded seat cover 60. The seat back portion 66 cannot extend beyond a certain recline due to back support stops 84 positioned on the upwardly extending arms 74 which prevent further reclinable rotation of back member 78. The leg portion 64 cannot extend beyond a certain position due to leg support stops 88 positioned on the upwardly extending arms 74 which prevent further downward rotation of the leg member 66.

Folding for storage is best accomplished with the front and rear supports 18, 20 removed from the housings 46, 48, and the seat 12 folded on itself as shown in FIG. 13.

Figure 19:
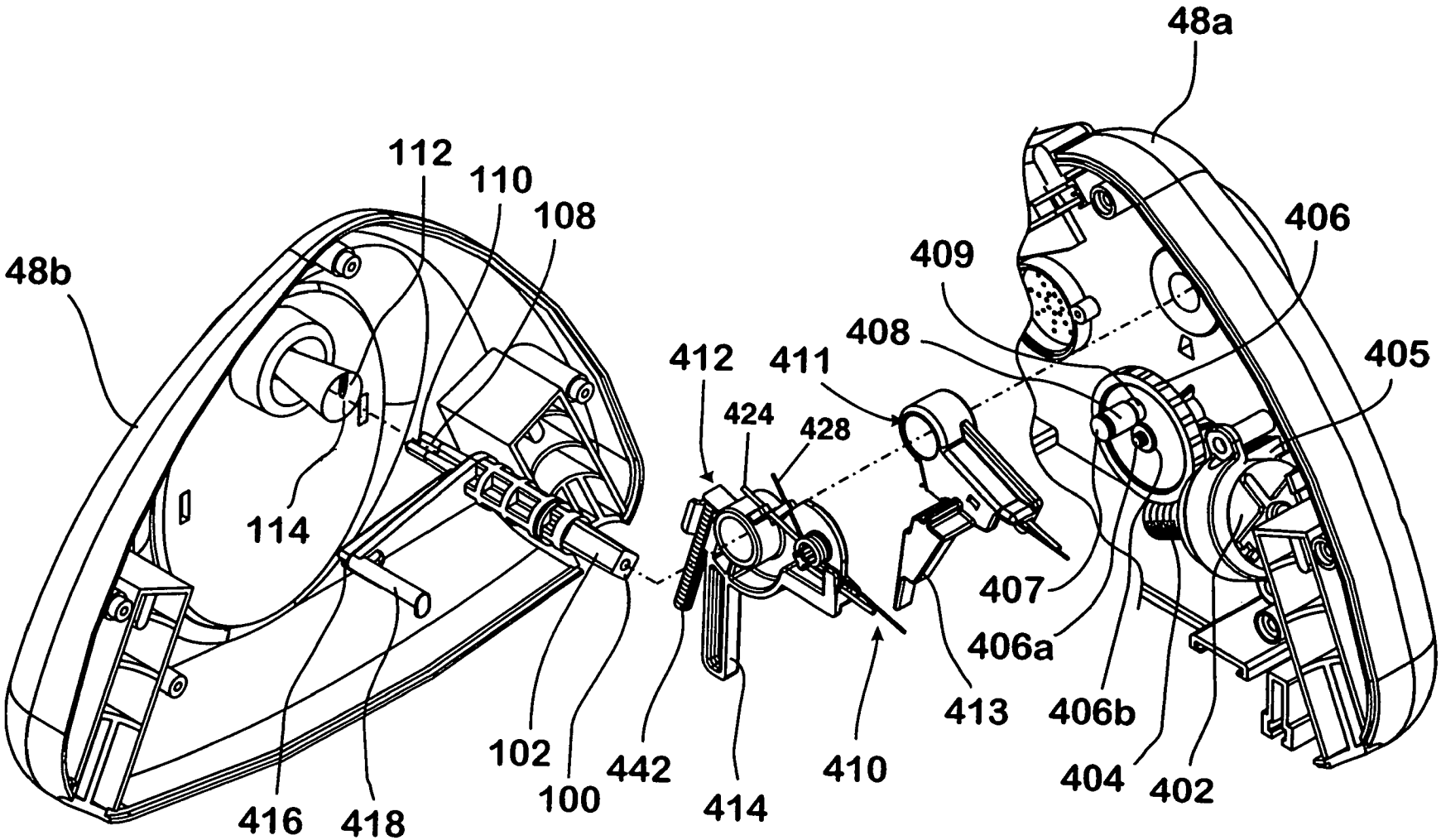
FIG. 19 is an exploded perspective view of the pivot housing containing the third embodiment of the drive assembly.

As shown in FIG. 7, each arm 74 matingly engages an outward extending end 100 of an axle 102. End 100 of axle 102 is preferably square shaped and engages a square receiving hole 101 in the respective arm 74 to matingly engage arms 74 and pivot housings 46, 48. As the square end 100 of the axle 102 rotates (driven by a motor discussed below), the seat 12 moves through an arc. The axle 102 is rotatably disposed in each pivot housing 46, 48 by means of bearing 104 having a hole 106 therethrough. The bearing 104 is slidably engaged, such that it can only be removed to the interior of the respective housing 46, 48 within a bearing hole 105 in the respective interior wall 46*a*, 48*a* of housing 46, 48, shown in F*igure* 11. Opposed end 108 of axle 102 is preferably semi-cylindrical shaped and has a central groove 110 to be received in a complementary circular slot 112 in the wall 48*b* of housing 48. Slot 112 includes a member 114 to engage groove 110 on the end 108 of axle 102 (see FIG. 19).

Figure 8:
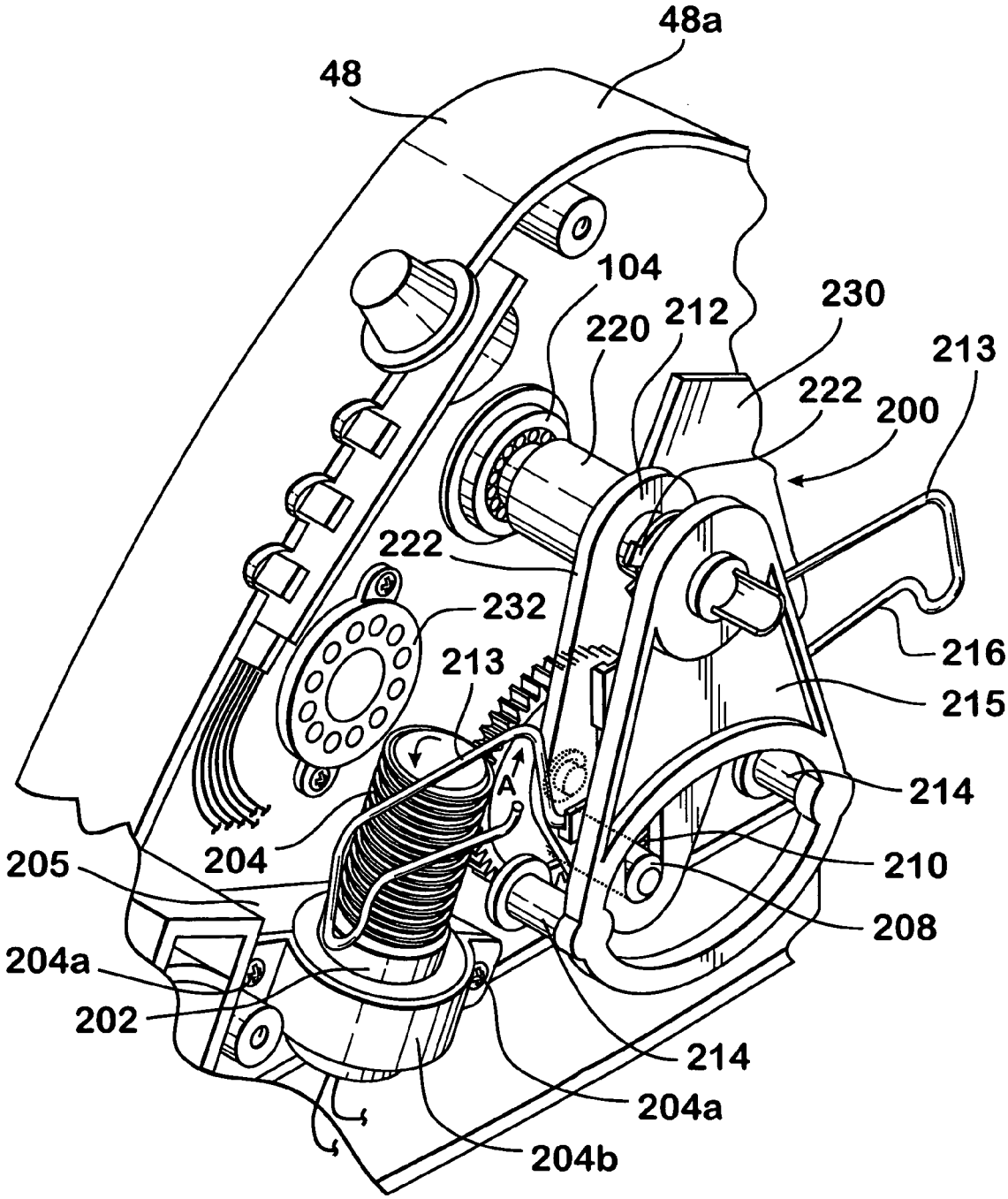
FIGS. 8-9 are partial perspective views of the interior of the pivot housing showing a first embodiment of the drive assembly taken from the perspective of arrow I in FIG. 1.
Figure 9:
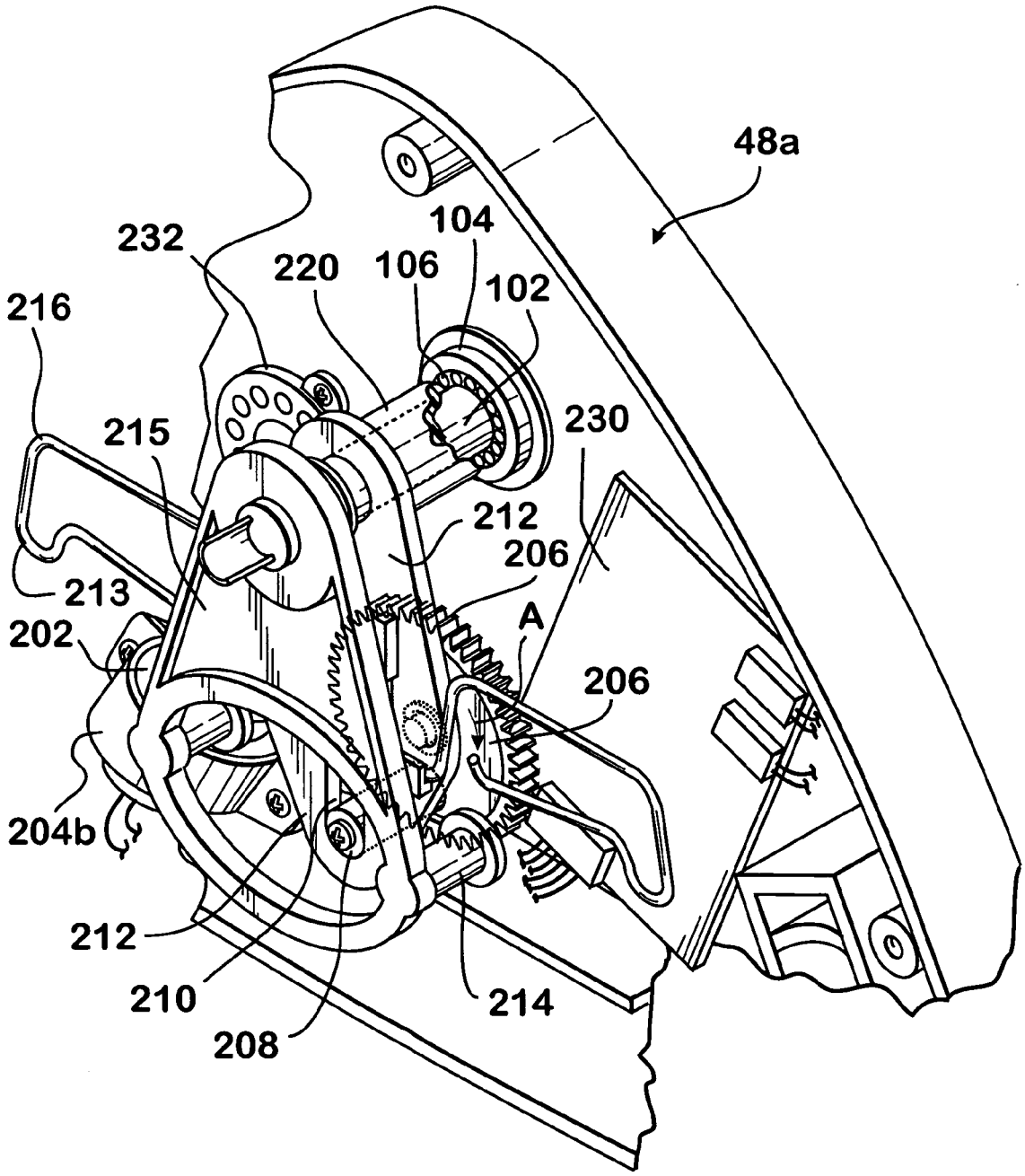
Figure 10:
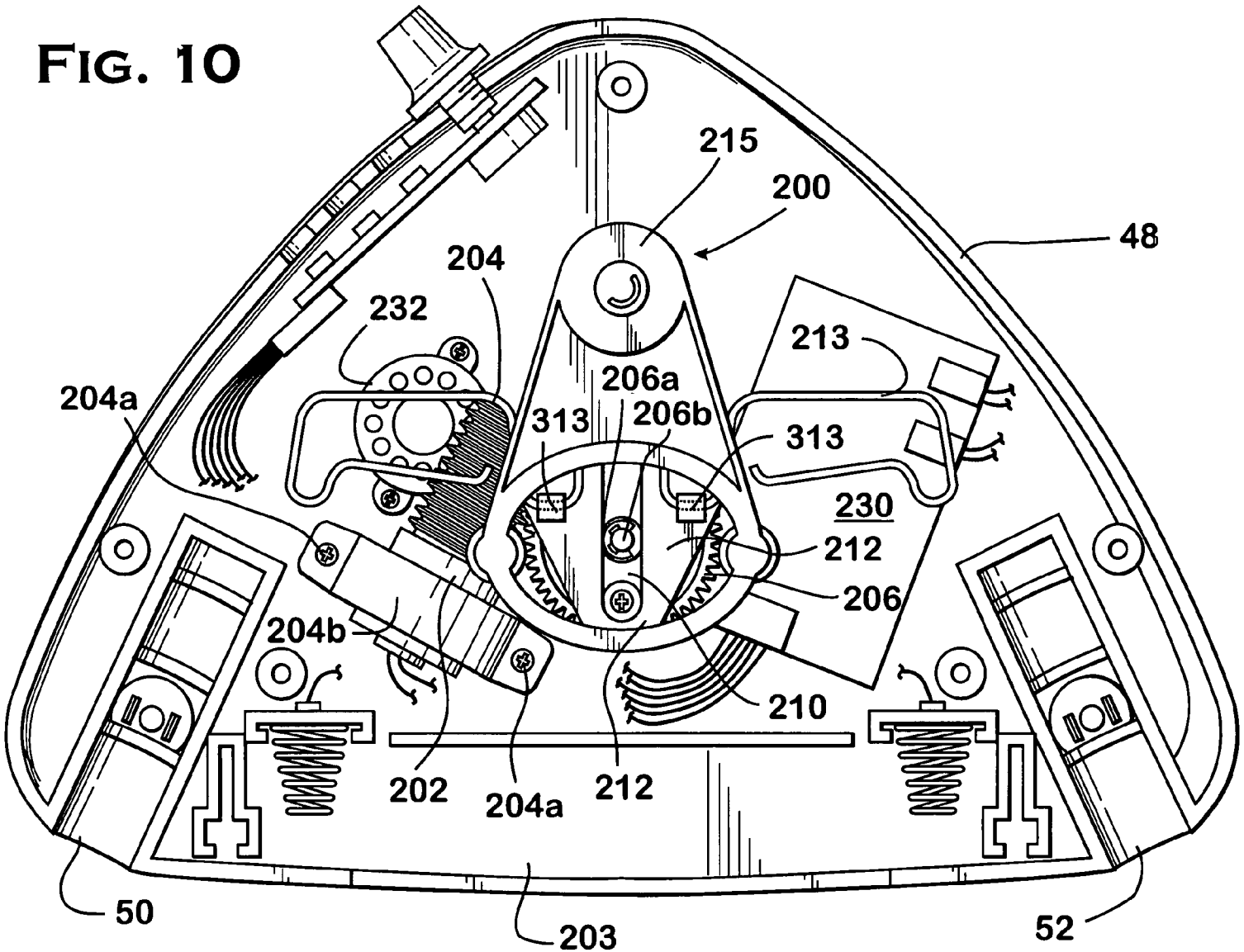
FIG. 10 is a plan view of the interior of the pivot housing showing the first embodiment of the drive assembly of the present invention taken from the perspective of arrow I in FIG. 1.

FIGS. 8-10 show a first embodiment of a drive assembly 200 contained within pivot housing 48. One of ordinary skill in the art would appreciate that the drive assembly 200 could be contained within either or both of the pivot housings 46, 48.

In operation, the motor 202, which is preferably battery operated by batteries contained within the battery housing 203, turns a rotatably mounted worm 204. Screws 204*a* and bracket 204*b* hold the motor 202 within housing 205 formed on the interior wall 48*a* of the pivot housing 48 and shaped to conform to the shape of the motor 202.

Worm 204 meshingly engages and turns a worm gear 206 in the direction indicated by arrow A. C-clip 206*a* retains the worm gear 206 to a gear seat pin 206*b* having a groove 206*c* thereon that engages the clip 206*a* about which the gear 206 can freely rotate. The worm gear 206 includes a rod 208 mounted to integral seat 209, displaced from the center of gear 206, by means of a screw 207. Rod 208 moves within a slot 210 (first embodiment shown in FIGS. 8-10) or partial slot 210*a* (second embodiment shown in FIGS. 11, 12, and 12A) in an arm plate 212. The rod's motion transverse to the slot 210 moves the arm plate 212 in a reciprocating fashion. An urging member 216 having one or more arms 213 mounted on the arm plate 212 within seats 313 pushes a stud 214 (or two studs in the case of two arms) mounted on a stud plate 215. The arms 213 are preferably made from thin flexible wire, and as shaped in the above-mentioned Figures, the arms are more prone to resist bending with time, as opposed to the straight arms 652 shown in U.S. Pat. No. 6,626,766 to Hsia.

The stud plate 215 shares the axis of rotation 16 with the seat 12, but rotates freely with respect to the arm plate 212, and also turns the axle 102. Turning the axle 102 rotates the upwardly extending arms 74, which in turn moves the seat 12 through its arc.

The embodiments shown in FIGS. 8-10 and 11-12A are somewhat different. In both embodiments, the arm plate 212 includes a hollow cylindrical sleeve 220 rotatably mounted on the axle 102. Preferably, one or two C-shaped clips 222 are fitted within an annular groove 224 (shown in FIG. 11) in the axle 102 to prevent axial displacement of the sleeve 220.

The embodiment shown in FIGS. 8-10 uses an urging member 216 having two arms 213 on either side of the arm plate 212 to push against the studs 214 and thus the motor drives the seat through both directions of its arc. Each of the arms 213 engages an associated one of the two studs 214 in such a manner that swinging of the arm plate 212 about the axis of rotation 16 results in alternate pushing of the studs 214 by the arms 213, which, in turn, results in a swinging of the upwardly extending arms 74 about the axis of rotation 16.

Figure 11:
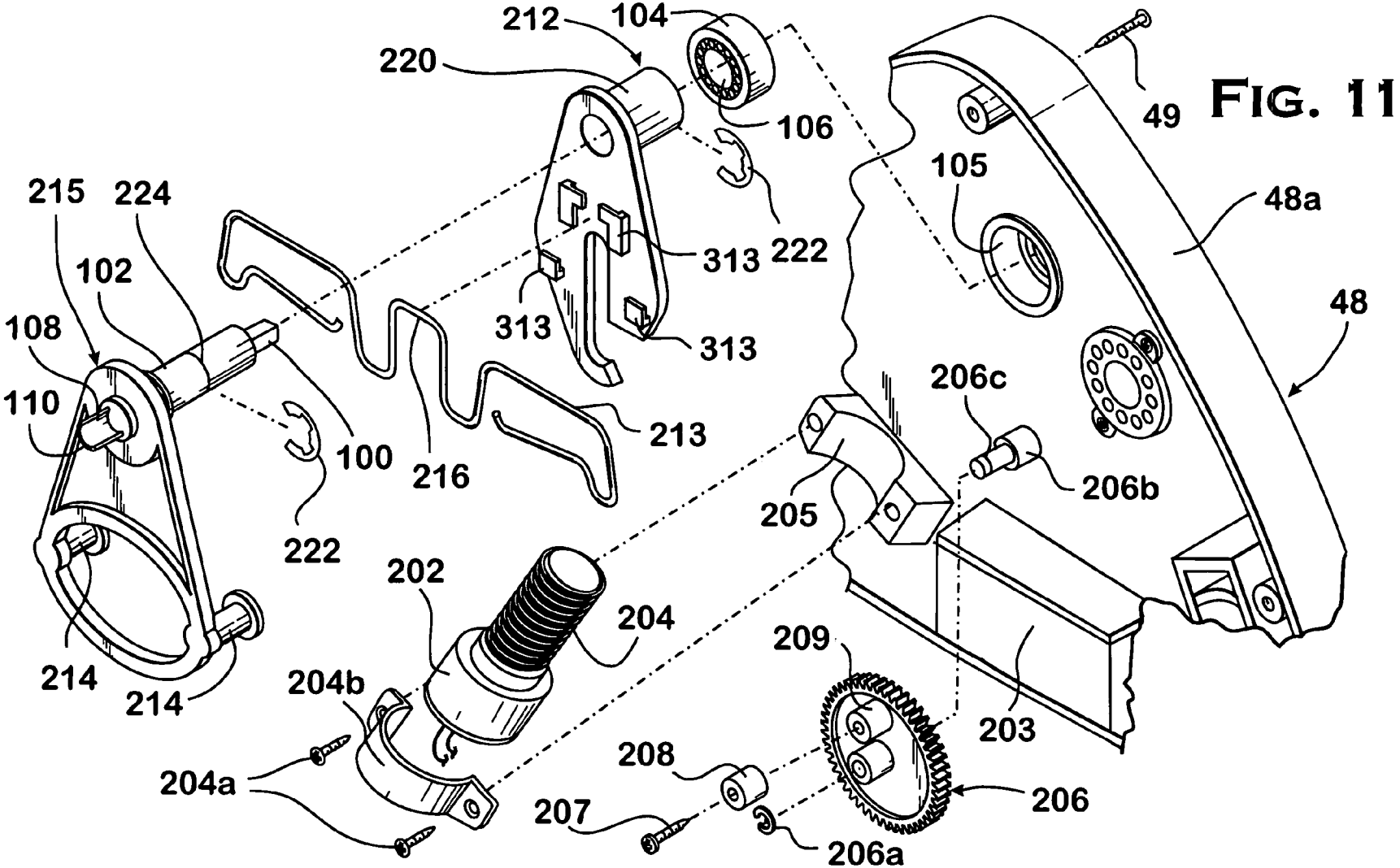
FIG. 11 shows an exploded view of a second embodiment of the drive assembly.

The embodiment shown in FIGS. 11, 12, and 12A, by contrast, uses an urging member 216 having a single arm 213 to move the seat 12 along one direction of its arc during one angular portion of rotation of the rod 208. During a portion of the return path, the seat 12 falls along the path due to gravity because the partial slot 210*a* does not engage the post 208 during the "free fall" of the swing. Further, during this fall, the motor 202 is not pushing the swing, which saves wear on the motor 202 because it only operates to push the swing in one direction. Finally, less plastic material is needed in the arm plate 212.

External buttons or dials 250 on the pivot housing 48 (shown in FIG. 1) containing the motor 202 operate the motor 202. The buttons or dials 250 activate the motor 202 and adjust its speed, which in turn adjusts the speed of the seat 12 along the arc.

The buttons or dials 250 on the housing also activate a sound system that can play music or sounds to entertain or soothe a child. The sound system is run by the circuit board 230 and the sound is generated through a speaker 232. The buttons or dials 250 turn the system on, make adjustments in volume, change the station, and/or change the sound generated.

As shown in FIG. 1, a decorative display 90 mounts on the upwardly extending arm 74 to entertain the child. Such a display 90 could be removable if the child did not like it, or could have a mobile type toy attached thereto that swings with the motion of the seat 12 along its arc.

FIGS. 14-19 illustrate a third embodiment of a drive assembly 400 contained within pivot housing 48. One of ordinary skill in the art would appreciate that the drive assembly 400 could be contained within either or both of the pivot housings 46, 48.

In operation, the motor 402, which is preferably battery operated, drives a rotatably mounted worm 404 in the direction of arrow B. Screws 404*a* and bracket 404*b* hold the motor 402 within its shaped housing 405 formed on the interior wall 48*a* of pivot housing 48 and shaped to conform to the exterior of motor 402.

Worm 404 meshingly engages and turns a worm gear 406 in the direction indicted by arrow C. The worm gear 406 is secured to a gear seat pin 406*a* about which the gear 406 can freely rotate. The worm gear 406 can be secured to pin 406*a* by a C-clip 406*b* or any other suitable securing means. The worm gear 406 includes a rod 408 mounted to integral seat 409 by a screw 407 or any other suitable securing means. Rod 408 and integral seat 409 are displaced from the center of gear 406.

A pivot assembly 410 is mounted upon the axle 102 within pivot housing 48. Pivot assembly 410 preferably comprises a pair of drive members 411, 412 mounted to swing about axle 102, each having a first portion 413, 414 and a second portion (unnumbered) integral with its associated first portion to form a substantially L-shaped configuration, and having an abutting member 416 fixedly secured to axle 102. The abutting member 416 preferably has an integral projection 418 that extends substantially parallel to the axis of rotation 16. First portions 413, 414 are preferably vertically positioned and lie on opposite sides of an axis 420 that is substantially perpendicular to the axis of rotation 16 (see FIG. 15). First portions 413, 414 are positioned on opposite sides of rod 408.

Each drive member 411, 412 preferably has a high force spring 422, 424 and a low force spring 426, 428 secured thereto. Springs 422, 424, 426, 428 are preferably torsion springs, however, any suitable spring may be used. With reference to drive member 411, springs 422, 426 are preferably wound about a seat portion 430 of drive member 411. A first end 432, 433 of each spring 422, 426 applies a force on a respective surface 432*a*, 433*a* of drive member 411, and a second end 434, 435 of each spring 422, 426 is adapted to engage and apply an upward force on projection 418 of abutting member 416. With reference to drive member 412, springs 424, 428 are preferably wound about a seat portion 436 of drive member 412. A first end 438, 439 of each spring 424, 428 applies a force on a surface 438*a*, 439*a* of drive member 412, and a second end 440, 441 of each spring 424, 428 is adapted to engage and apply a downward force on projection 418 of abutting member 416.

High force springs 422, 424 preferably provide the primary force driving the abutting projection 418, and, thus, the reciprocating motion of the seat 12. The low force springs 426, 428 preferably guide the abutting projection 418 to smoothly transition between upward and downward driving motions in order to eliminate play and noise during the opposed directions of the swing arc. Adjusting any of springs 422, 424, 426, 428 can aid swing performance by assisting the self-start capability of the swing (i.e. the ability of the device to begin swinging with a child in the seat without the assistance of an external force) and can increase or decrease the angle of the swing arc.

As worm gear 406 turns, the rotational movement of rod 408 selectively moves arms 413, 414 of drive members 411, 412 in a reciprocating fashion. A weight 442 can be secured to at least one of the drive members 411, 412 to bias the respective arm 413, 414 of the at least one drive member 411, 412 against rod 408 when the rod is driving the opposed arm in the opposite direction in order to aid in providing a smooth transition between the opposed directions of the swing arc (see FIGS. 15-19). As rod 408 is urged against arm 413 during one angular portion of its rotation, springs 422, 426 push projection 418 of the abutting member 416 upwardly, and as rod 408 urges against arm 414 during a remaining angular portion of its rotation, springs 424, 428 push projection 418 of abutting member 416 downwardly. This reciprocating movement of abutting member 416 causes axle 102 to move in opposing directions, which, in turn, results in swinging of the upwardly extending arms 74 about the axis of rotation.

While various methods, configurations, and features of the present invention have been described above and shown in the drawings for the various embodiments of the present invention, those of ordinary skill in the art will appreciate from this disclosure that any combination of the above features can be used without departing from the scope of the present invention. Accordingly, it is recognized by those skilled in the art that changes may be made to the above described methods and embodiments of the invention without departing from the broad inventive concept thereof. It is understood, therefore, that this invention is not limited to the particular methods and embodiments disclosed, but is intended to cover all modifications which are within the spirit and scope of the invention as defined by the appended claims and/or shown in the attached drawings.

What is claimed is:

1. An infant swing comprising:

a seat for holding an infant;

at least one upwardly extending arm secured to the seat;

at least one pivot housing rotatably connected to the at least one upwardly extending arm;

a support frame that extends upwardly from a support surface, the support frame engaging the at least one pivot housing and configured to enable the seat to rotate freely about the pivot housing;

at least one drive assembly housed within the at least one pivot housing, the drive assembly comprising:

an axle mounted in the at least one pivot housing and having one end joined to the at least one upwardly extending arm;

an abutting member fixedly secured to the axle;

first and second drive members pivotally mounted to rotate about the axle, said drive members each having a first portion adjacent to the abutting member and a second portion; and a motor seated within the at least one pivot housing, the motor being configured to drive a circular gear rotatably mounted in the pivot housing, the circular gear having a rod mounted eccentrically thereon and extending parallel to an axis of rotation of the circular gear;

wherein rotation of the circular gear drives the rod to selectively engage the second portions of the first and second drive members in an alternating fashion to drive the abutting member and thereby rotate the axle and the at least one upwardly extending arm in a given direction.

2. The infant swing of claim 1, further comprising a worm driven by the motor, wherein the worm meshingly engages and rotates the circular gear.

3. The infant swing of claim 1, further comprising a pair of opposed upwardly extending arms and a pair of opposed pivot housings, each upwardly extending arm being rotatably mounted to a respective pivot housing.

4. The infant swing of claim 1, wherein at least one spring mounted on the first and second drive members selectively drive the abutting member to rotate the axle.

5. The infant swing of claim 4, wherein a first spring and a second spring are mounted on the drive members.

6. The infant swing of claim 5, wherein the first spring exerts a high force on the abutting member to drive the abutting member to rotate the axle in a first angular direction, and the second spring exerts a low force on the abutting member.

7. The infant swing of claim 1, wherein the first and second portions of each drive member define a substantially L-shaped configuration, said the first and second portions extending radially outward from a central portion of each drive member.

8. The infant swing of claim 7, wherein the central portion of each drive member is rotatably mounted on the axle.

9. The infant swing of claim 7, wherein at least one spring mounted on each drive member selectively drives the abutting member to rotate the axle.

10. The infant swing of claim 1, wherein the at least one upwardly extending arm moves generally downwardly under the force of gravity when the rod moves generally in a second direction.

11. The infant swing of claim 1, wherein a second end of the axle is received within a slot in an exterior wall of the pivot housing, the slot having a member to limit the angle of rotation of the axle in said given direction.

12. The infant swing of claim 1, wherein the second portion of each drive member is positioned on opposed sides of the rod.

13. The infant swing of claim 12, wherein the first portion of each drive member selectively drives the abutting member in opposed directions to rotate the axle in said given direction.

14. The infant swing of claim 13, wherein at least one spring mounted on each drive member selectively drives the abutting member to rotate the axle.

15. The infant swing of claim 1, wherein the speed of the motor is adjustable.

16. The infant swing of claim 1, wherein a protective shield extending between an upper end of the at least one support arm and seat is provided to prevent an infant in the seat from moving into a region of the support frame.

17. The infant swing of claim 16, wherein the protective shield is a web sufficiently flexible to enable the swing to occupy a compact space when disassembled and stored.

18. A drive assembly for an infant swing comprising:

an axle coupled to at least one upwardly extending arm of a swing seat;

an abutting member fixedly secured to the axle; first and second drive members pivotally mounted on the axle;

a motor configured to drive a circular gear, the circular gear having a rod mounted eccentrically thereon and extending parallel to an axis of rotation of the circular gear;

wherein rotation of the circular gear and the rod selectively engage first portions of the first and second drive members in an alternating fashion to drive the abutting member in a given direction to rotate the axle and hence the swing seat.

19. The drive assembly of claim 18, further comprising a worm driven by the motor, the worm meshingly engaging and rotating the circular gear.

20. The drive assembly of claim 18, wherein at least one spring mounted on each drive member drives the abutting member in a given direction to rotate the axle.

21. The drive assembly of claim 20, wherein a first spring and a second spring are mounted on each drive member.

22. The drive assembly of claim 21, wherein the first spring exerts a high force on the abutting member to drive the abutting member to rotate the axle in a first angular direction, and the second spring exerts a low force on the abutting member.

23. The drive assembly of claim 18, wherein each drive member has a second portion, the first and second portions of each drive member define a substantially L-shaped configuration, said first and second portions extending generally radially outward from a central portion of each drive member.

24. The drive assembly of claim 23, wherein the central portion of each drive member is rotatably mounted on the axle.

25. The drive assembly of claim 23, wherein at least one spring mounted on each drive member selectively drives the abutting member in the given direction to rotate the axle.

26. The drive assembly of claim 23, wherein the second portion of the first and second drive members are each positioned on opposed sides of the rod.

27. The drive assembly of claim 26, wherein the first portion of each drive member selectively drives the abutting member in opposed directions to rotate the axle.

28. The drive assembly of claim 26, wherein at least one spring mounted on each drive member selectively drives the abutting member to rotate the axle.

29. The drive assembly of claim 18, wherein the at least one upwardly extending arm moves generally downwardly under the force of gravity during a second angular portion of rotation of said gear.

30. The drive assembly of claim 18, wherein the speed of the motor is adjustable.

* * * * *